United States Patent [19]

Hansen et al.

[11] Patent Number: 5,039,249

[45] Date of Patent: Aug. 13, 1991

[54] APPARATUS FOR SCREENING AND TROWELLING CONCRETE

[76] Inventors: Joel D. Hansen; Meloy F. Hansen, both of 5819 Fox Hunt Dr., Arlington, Tex. 76017

[21] Appl. No.: 395,599

[22] Filed: Aug. 18, 1989

[51] Int. Cl.[5] ..... E01C 19/30; E01C 19/42; E01C 23/07

[52] U.S. Cl. ..... 404/84; 404/114; 404/118

[58] Field of Search ..... 404/84, 85, 86, 72, 404/75, 112, 114, 118, 120; 299/1, 33, 41, 51; 175/161, 203, 202

[56] References Cited

U.S. PATENT DOCUMENTS

| | | | |
|---|---|---|---|
| 3,374,717 | 3/1968 | Reynolds, Jr. | 404/118 X |
| 3,406,761 | 10/1968 | Ryan | 404/118 X |
| 3,595,144 | 8/1968 | Rink | 404/84 |
| 3,873,226 | 7/1973 | Teach | 404/84 |
| 3,896,570 | 7/1975 | McMurray | 37/80 A |
| 3,953,145 | 3/1975 | Teach | 404/84 |
| 4,057,117 | 11/1977 | Bermingham | 175/161 X |
| 4,371,287 | 6/1980 | Johansson | 404/84 |
| 4,403,889 | 6/1981 | Gillotti | 404/72 |
| 4,655,633 | 9/1985 | Somero et al. | 404/75 |
| 4,752,156 | 6/1988 | Owens | 404/118 |
| 4,795,332 | 1/1989 | Davis | 404/118 X |

*Primary Examiner*—Stephen J. Novosad
*Attorney, Agent, or Firm*—Timmons & Kelly

[57] ABSTRACT

Disclosed is an apparatus for screeding or trowelling concrete or similar materials. The apparatus has a turret, mounted on a mobile frame. A telescopic boom is mounted in cantilevered fashion on the turret. A machine head, mounted on the distal end of the boom, is rotatable about a vertical axis. An attachment, such as a screed or a trowel, is attached to the machine head. The level and angle of the frame can be set to a selected elevation relative to a rotating laser beam by raising or lowering three hydraulic legs. The machine head can raise or lower the attachment to set the attachment at a selected elevation.

16 Claims, 4 Drawing Sheets

APPARATUS FOR SCREENING AND TROWELLING CONCRETE

BACKGROUND OF THE INVENTION

1. Field of the Invention

This invention relates in general to methods and apparatus for manipulating material such as concrete, sand, gravel, or other loose material. In particular, the invention relates to apparatus for screeding and trowelling concrete to a smooth, level surface.

2. Description of the Prior Art

When concrete is poured, the concrete must be leveled and smoothed (screeded) before the concrete sets. A screeding machine is often used to level the concrete, especially when a large area of concrete is to be poured. Such machines are generally required to move along heavy, cumbersome rails or guides. A trowelling machine may then be used to smooth the surface of the concrete.

U.S. Pat. No. 4,655,633, issued Apr. 7, 1987, to Somero et al., discloses a screeding apparatus having a cantilevered boom mounted on a frame. A screed is mounted on the boom for movement along the boom. The elevation of the screed is automatically adjusted relative to a laser beacon reference plane. The boom can be rotated about a vertical axis and can be extended and retracted.

U.S. Pat. No. 4,371,287, issued Feb. 1, 1983, to Johansson, discloses a trowelling device. The Johansson device includes a cantilever arm on a carrier. A trowel is carried in a pedestal structure located at the distal end of the arm. The vertical position of the trowel can be adjusted to a selected position relative to a horizontal laser beam.

When a large concrete floor is poured, there may be obstructions in the floor, such as plumbing pipes or vertical columns. These obstructions may not allow a screeding or trowelling device to move straight across the floor. In such cases, it is desirable for the screed or trowel to be very maneuverable. In particular, it is helpful if the head can be rotated about a vertical axis as the head is pulled or pushed across the floor. Such rotation, combined with the other movements of the current machine, would create maneuverability which not only would allow the apparatus to be effective in a wider range of applications, but also would permit concrete to be moved over large distances in any direction.

Despite the prior art just mentioned, screeding concrete by manually passing the edge of two by four planks across the surface of the concrete is still prevalent today when pouring floors of buildings or parking lots. This is because prior art machines are either too large and immobile (slip-form pavers) or require large guides or rail supported screeds. Such guided screeds are cumbersome and labor intensive to set-up and usually require slabs to be poured in strips between the guides. Strip pouring is time consuming because a subsequent strip can not be poured until the previous one has set. However, manually screeding with two by four planks is also labor intensive and is not as precise as machines.

SUMMARY OF THE INVENTION

The present invention is a screeding and troweling apparatus which does not require cumbersome rails or guides for use with spreadable materials. The apparatus of the invention includes a frame supported by wheels.

A turret is mounted on the frame for rotation about a vertical axis. A telescopic boom is mounted in a cantilevered fashion on the turret. A machine head is located on the distal end of the boom. An attachment, such as a screed or a trowel may be connected to the machine head for contact with the material. The boom can be retracted or extended to move the machine head toward or away from the frame. The machine head can also be rotated about a vertical axis, and can be raised and lowered.

A laser beam receiver is mounted on the frame for sensing a laser beam that periodically sweeps in a horizontal plane. The beam originates from a laser source located off the apparatus which is used periodically as a reference elevation to position the frame. The elevation of the frame and the elevation of the attachment can be adjusted relative to the plane of the laser beam.

DESCRIPTION OF THE PREFERRED EMBODIMENT

Figures 1, 2:
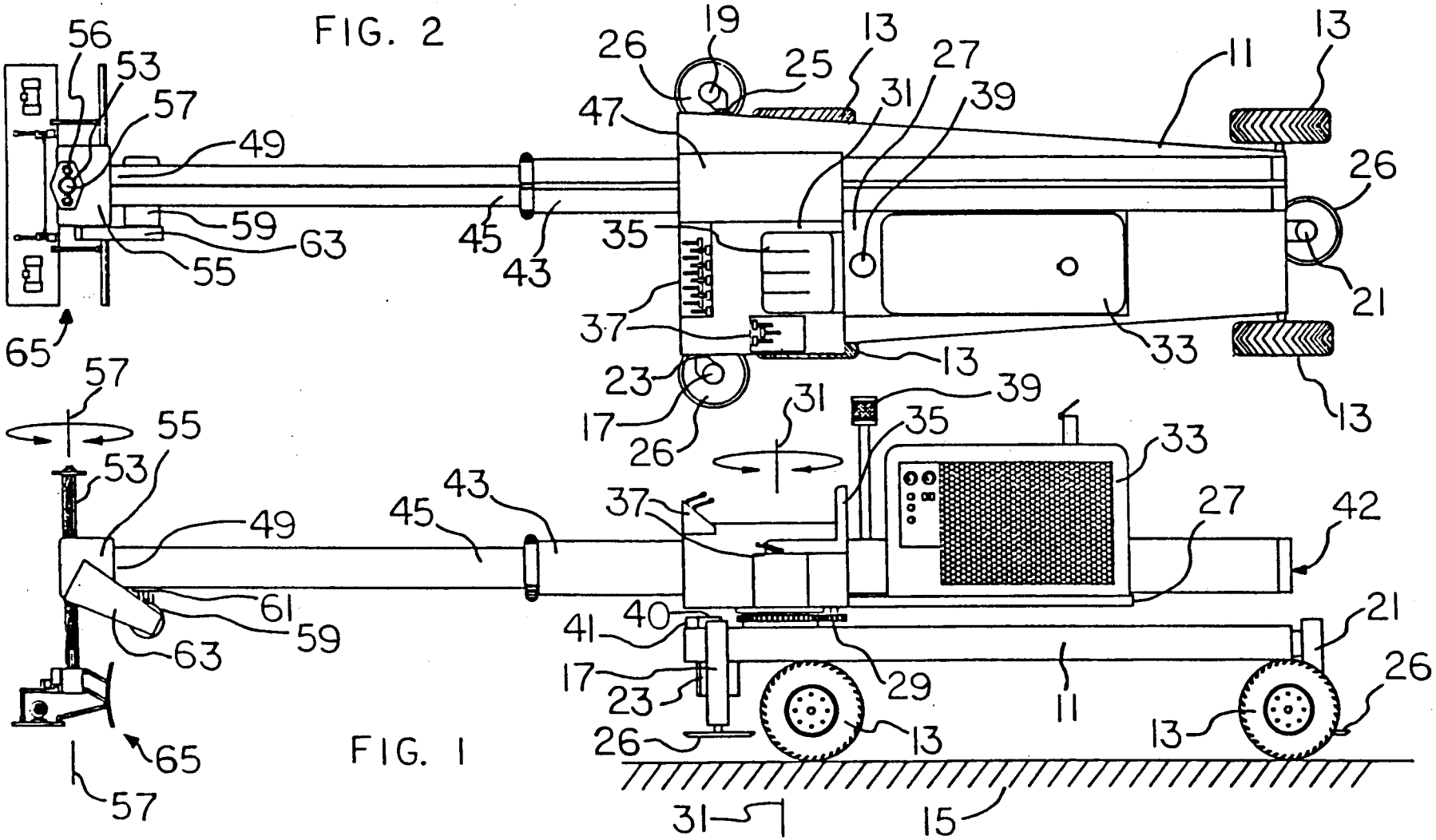
FIG. 1 is a side view of the preferred embodiment of the invention.
FIG. 2 is a top view of the preferred embodiment of the invention.

As shown in FIGS. 1 and 2, the preferred embodiment of the invention includes a supporting frame 11, mounted for transport on four balloon type tires 13. At least one of the tires 13 is driven to propel the frame 11 over a support surface 15.

The frame 11 can be supported by three hydraulic legs 17, 19, and 21. The left leg 17 and the right leg 19 are mounted on the ends of leg extenders 23 and 25. The leg extenders 23 and 25 can be hydraulically extended to place the left leg 17 and the right leg 19 at a selected distance from the frame 11. The leg extenders 23 and 25 can be retracted to pull the left and right legs 17 and 19 close to the frame 11 to give the apparatus a narrow width for travel.

Each leg 17, 19, and 21 has a large load distributor 26 on the lower end, so that the legs 17, 19, and 21 will not sink into the supporting surface 15. The legs 17, 19, and 21 can be raised and lowered to level the frame 11 and to place the frame 11 at a selected elevation.

A turret 27 is mounted on the frame 11 with a ring gear 29. The ring gear 29 allows the turret 27 to rotate about a vertical axis 31. A gasoline or diesel engine 33 is mounted on the turret 27 for providing power to the apparatus. The engine 33 and the driven tire 13 are propulsion means for moving the frame 11 over the support surface 15.

Also mounted on the turret 27 is an operator's seat 35. Hydraulic controls 37 for controlling the apparatus are located within reach of the operator's seat 35.

A laser receiver 39 is also mounted on the turret 27, between the engine 33 and the operator's seat 35. The laser receiver 39 senses the elevation of a laser beam periodically moving in a horizontal plane. The frame 11 can be set at a selected elevation relative to the plane of the laser beam by extending or retracting the right leg 19 in response to the laser receiver 39.

The frame 11 is then leveled by means of a pair of inclinometers 40 and 41. The inclinometers 40 and 41 are mounted on the frame 11 and sense the level of the frame 11 along two perpendicular lines. For example, one inclinometer 40 may sense the level of the frame 11 from side to side and the other inclinometer 41 would sense the level from front to rear.

The frame 11 is set at a selected elevation by setting the right leg 19 in response to the laser receiver 39. Then, using the first inclinometer 40, the left leg 17 is set. Finally, using the other inclinometer 41, the rear leg 21 is set.

A triangular boom 42 is mounted on the turret 27 in cantilevered fashion. The boom 42 has an outside arm 43 and an inside arm 45. The outside arm 43 is connected to the turret 27 and rotates with the turret 27 about the vertical axis 31. A boom guard 47 covers a portion of the outside arm 43. The inside arm 45 is telescopically received within the outside arm 43. The inside arm 45 can be moved by hydraulic means and the outside arm 43 can be moved by means of a rack and pinion. This allows the distal end 49 of the boom 42 to move away from or toward the frame 11.

Figure 3:
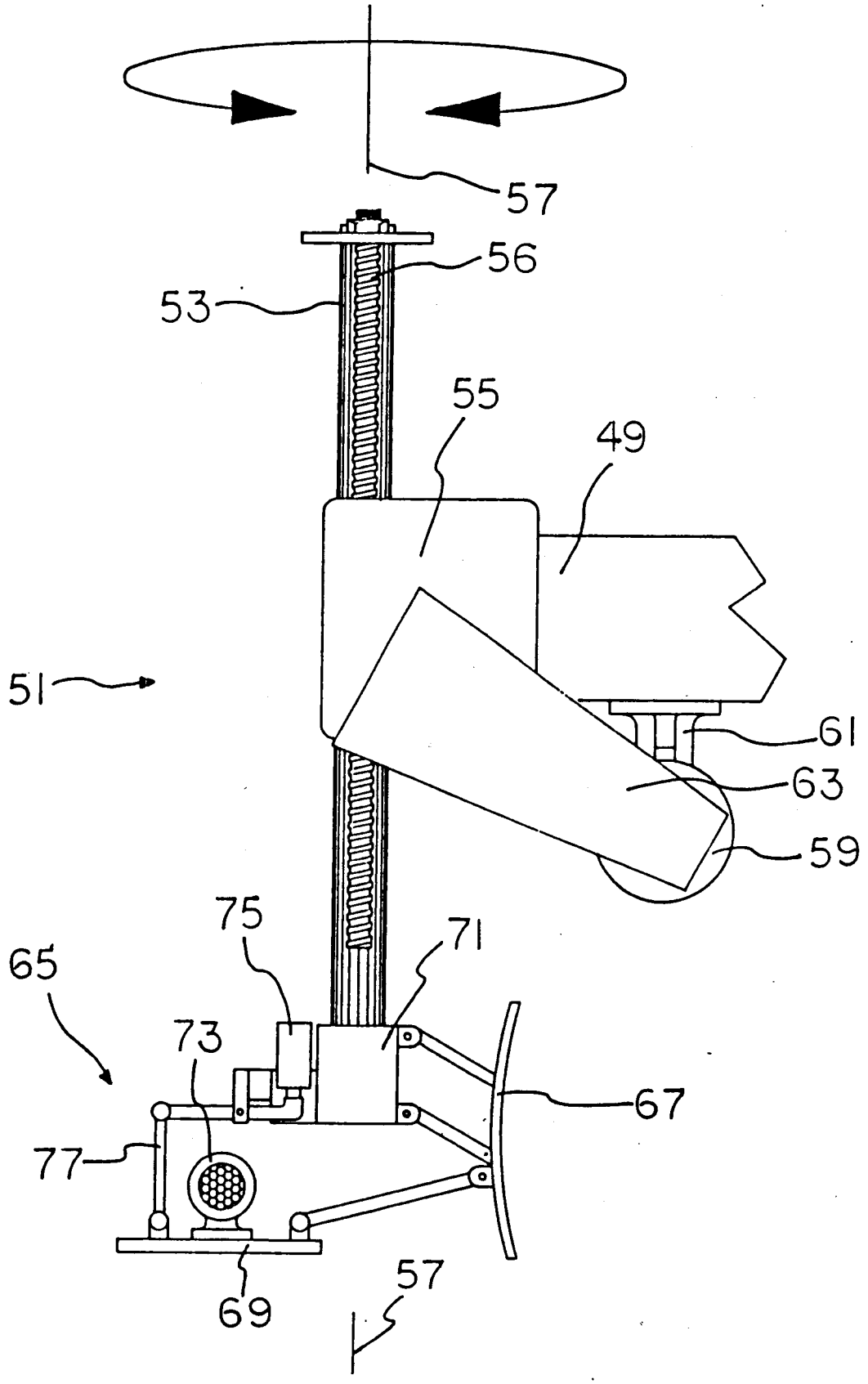
FIG. 3 is a detailed side view of the machine head of the invention with a screed attachment.
Figure 4:
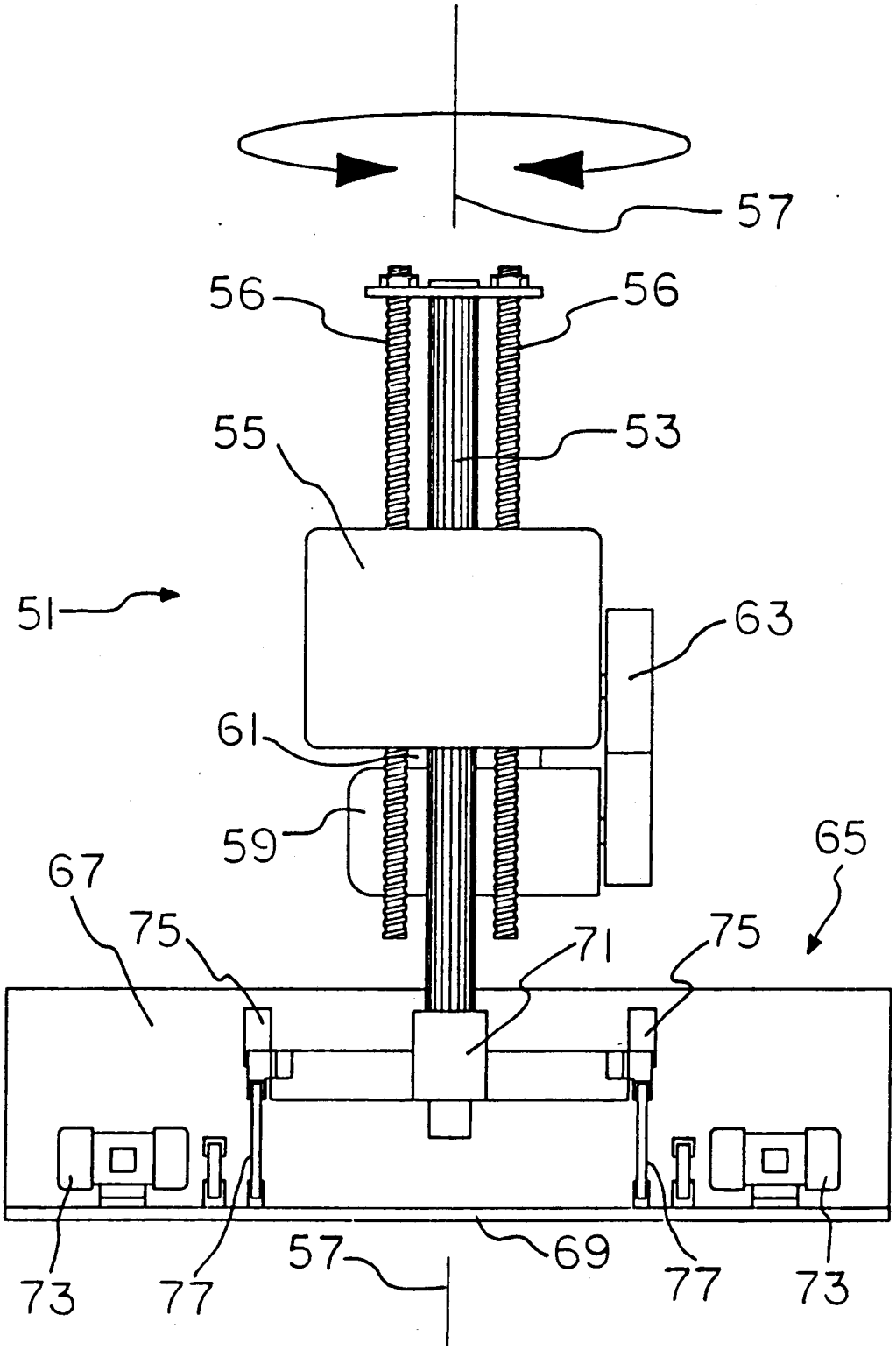
FIG. 4 is a detailed front view of the machine head of the invention, with the screed attachment.

As shown in FIGS. 1 and 2, a machine head 51 is mounted on the distal end 49 of the boom 42. The machine head 51 is shown in greater detail in FIGS. 3 and 4. The machine head 51 includes a head shaft 53 that passes through a gear box 55. Also passing through the gear box 55 are two lifting rods 56.

The gear box 55 is connected to the distal ends 49 of the boom 42. The gear box 55 contains gears for rotating the head shaft 53 about a vertical axis 57 and gears which mesh with the lifting rods 56 to move the shaft 53 up and down. The gear box is controlled by a motor 59 mounted on a motor base 61 connected to the lower surface of the boom 42. A motor guard 63 shields the coupling between the motor 59 and the gear box 55.

An attachment 65 is connected to the lower end of the head shaft 53. The particular attachment 65 shown is a screed attachment 65. The screed attachment 65 includes a screed blade 67 and a concrete float 69 connected to a support member 71. A pair of float vibrators 73 are mounted on the top of the float 69 to vibrate the float 69.

The screed blade 67 is a typical concave blade for contact with the material to be screeded. As the machine head 51 is rotated about the vertical axis 57, the screed blade 67 also rotates.

The float 69 is a typical concrete float, used for smoothing the surface of the material. A pair of solenoids 75, also mounted on the support member 71, are connected to the float 69 through a series of arms 77, to raise and lower the float 69 relative to a screed blade 67. Thus, the screed blade 67 can be used with or without the float 69.

The machine head 51 can also be raised and lowered by the gear box 55. As the machine head 51 is raised and lowered, the elevation of the screed attachment 65 is changed. The gear box 55 is responsive to the laser receiver 39 to adjust the elevation of the attachment 65 relative to the elevation of the laser beam periodically moving in a horizontal plane.

Figure 5:
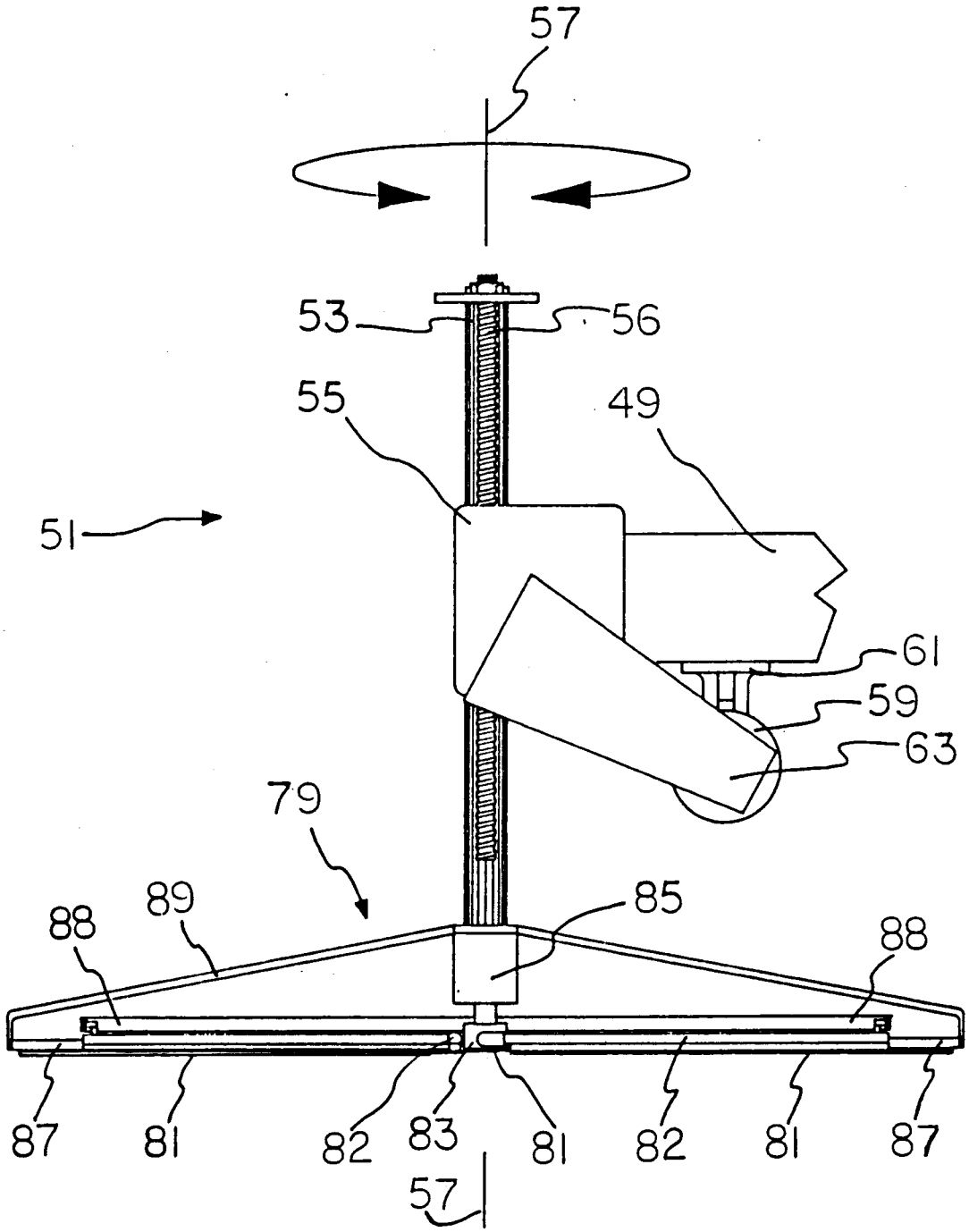
FIG. 5 is a side view of a trowel attachment for the machine head of the invention.

FIG. 5 shows an alternative attachment 79 connected to the lower end of the machine head 51. The alternative attachment is a trowel 79, having four rotating blades 81. The blades 81 are attached to trowel arms 82 which are attached to a hub 83. The hub 83 is attached to a support member 85 which can be removed from the head shaft 53. The blades 81 are protected by a bumper guard ring 87 that is attached to the support member 85 by a bumper guard ring supporting member 89. A second ring 88 is attached to the four trowel arms 82 in order to keep the blades 81 from fluttering. The blades 81 are rotated by the machine head 51.

In operation, the preferred embodiment of the invention can be used to screed and trowel concrete. Using the inclinometers 40 and 41, the frame 11 is leveled at a selected elevation relative to the plane of the laser beam. The frame 11 can also be set at an angle relative to the plane of the laser beam by using the inclinometers 40 and 41 to adjust the legs 17 and 21 to different elevations. Thus, the invention is capable of screeding and troweling concrete of varying slopes.

Once the frame 11 is positioned in space, the boom 42 is then extended to move the machine head 51 away from the frame 11. The screed attachment 65 is then lowered to a selected elevation relative to the laser beam with the screed blade 67 facing toward the frame 11 and perpendicular to the length of the boom 42. Then, the boom 42 is retracted, pulling the screed blade 67 along the surface of the concrete. Once the boom 42 is retracted, the machine head 51 can then rotate the screed blade 67 180 degrees away from the frame 11 and upon extension of the boom 42, the concrete can be pushed and screeded away from the frame 11.

Similarly, concrete can be moved and screeded laterally in relation to the frame 11, by rotating the screed blade 67 so that the blade 67 is parallel to the length of the boom 47. With the screed blade 67 in this position, it is then swept along the surface of the concrete by the action of the turret 27 rotating about the axis 31. Thus, concrete can be placed and screeded in any direction in relation to the frame 11.

If an obstruction is encountered, the machine head 51 and the screed blade 67 can be rotated about a vertical axis 57. This rotation, in conjunction with the rotation of the turret 27 about its axis 31 and the extension or retraction of the boom 42, allows the screed blade 67 to be moved around the obstruction.

The apparatus of the invention has several advantages over the prior art. The improved maneuverability of the machine head 51 allows the screed attachment 65 to be moved around obstructions in the area. It also allows for concrete or other materials to be moved over large distances in any direction. Also, the attachment on the machine head 51 can be changed. Thus, the machine head 51 can control a trowel attachment 79 as well. Furthermore, the legs 17, 19, and 21 can be set at different elevations to position the frame 11 at an angle to the horizontal, so that a concrete slope can be screeded.

The current apparatus significantly reduces the labor to pour concrete as it uses no guides or rails and is controlled by a single operator. No guides or rails also means slabs can be continously poured without the time and expense of waiting until the next day for strips to cure. This machine can also be driven on cured concrete, subgrade, or through uncured concrete providing further flexibility and mobility to complete jobs in a single pour.

It can also reduce the material necessary when pouring slabs since subgrades can be more accurately graded and slab thickness can be tightly controlled to within an eighth of an inch by the laser leveling mechanism. Furthermore, concrete can be poured at lower slumps creating higher quality, higher strength slabs since the apparatus is not restricted, like man, in power to move material.

Finally, the present invention is not limited only to screeding concrete, but also has trowelling capability as well. Thus, one machine can be used where two were previously necessary. The broad sweeping motion of the boom combines with the high speed rotation of the trowel blades to produce an extremely flat surface with a high quality finish.

The invention has been shown in only one of its embodiments. It should be apparent to those skilled in the art that the invention is not so limited, but is susceptible to various changes and modifications without departing from the spirit of the invention.

We claim:

1. An apparatus for screeding concrete, comprising;
a frame;
a turret mounted on the frame for rotation about a vertical axis;
a telescopic boom mounted in cantilevered fashion on the turret;
a machine head mounted on the end of the boom, the machine head being rotatable about a vertical axis; and
a screed attachment connected to the machine head for screeding the concrete.

2. An apparatus as defined in claim 1, further comprising means for setting the screed attachment at a selected elevation.

3. An apparatus as defined in claim 2, wherein the means for setting the screed attachment at a selected elevation comprises:
a laser receiver for sensing the elevation of a laser beam periodically moving in a horizontal plane; and
adjustment means responsive to the laser receiver for adjusting the elevation of the screed attachment to a predetermined relationship to the plane of the laser beam.

4. An apparatus as defined in claim 1, further comprising leveling means for leveling the frame.

5. An apparatus as defined in claim 4, wherein the leveling means includes a pair of inclinometers mounted on the frame in order to sense the level of the frame along two perpendicular lines.

6. An apparatus as defined in claim 1, further comprising a plurality of nonlinear adjustable legs attached to the frame.

7. An apparatus as recited in claim 1, further comprising propulsion means for moving the frame over a support surface.

8. An apparatus for screeding concrete, comprising:
a frame;
a turret mounted on the frame for rotation about a vertical axis;
a telescopic boom mounted in cantilevered fashion on the turret;
a machine head mounted on one end of the boom, the machine head being rotatable about a vertical axis;
a screed attachment connected to the machine head for screeding the concrete;
three nonlinear adjustable legs for supporting the frame;
a laser receiver for sensing the elevation of a laser beam periodically moving in a horizontal plane;
adjustment means responsive to the laser receiver for adjusting the elevation of the screed attachment to a predetermined relationship to the plane of the laser beam;
leveling means for leveling the frame, including a pair of inclinometers mounted on the frame in order to sense the level of the frame along two perpendicular lines; and
propulsion means for moving the frame over a support surface.

9. An apparatus for trowelling concrete, comprising:
a frame;
a turret mounted on the frame for rotation about a vertical axis;
a telescopic boom mounted in cantilevered fashion on the turret;
a machine head mounted on the end of the boom, the machine head being rotatable about a vertical axis; and
a trowel connected to the machine head for trowelling the concrete.

10. An apparatus as defined in claim 9, wherein the trowel can be removed and replaced with a screed attachment for screeding the concrete.

11. An apparatus as defined in claim 9, further comprising means for setting the trowel at a selected elevation.

12. An apparatus as defined in claim 11, wherein the means for setting the trowel at a selected elevation comprises:
a laser receiver for sensing the elevation of a laser beam periodically moving in a horizontal plane; and
adjustment means responsive to the laser receiver for adjusting the elevation of the trowel to a predetermined relationship to the plane of the laser beam.

13. An apparatus as defined in claim 9, further comprising leveling means for leveling the frame.

14. An apparatus as defined in claim 13, wherein the leveling means includes a pair of inclinometers mounted on the frame in order to sense the level of the frame along two perpendicular lines.

15. An apparatus as defined in claim 9, further comprising a plurality of nonlinear adjustable legs attached to the frame.

16. An apparatus as defined in claim 9, further comprising propulsion means for moving the frame over a support surface.

* * * * *